US006575705B2

(12) United States Patent
Akiyama et al.

(10) Patent No.: US 6,575,705 B2
(45) Date of Patent: Jun. 10, 2003

(54) JET PUMP THROAT PIPE HAVING A BENT DISCHARGE END

(75) Inventors: Yasunori Akiyama, Atsugi (JP); Taiki Aoyama, Hadano (JP); Tsuyoshi Kato, Yokohama (JP); Itsuo Honda, Yokohama (JP)

(73) Assignees: Nissan Motor Co., Ltd., Yokohama (JP); Nifco Inc., Yokohama (JP)

( * ) Notice: Subject to any disclaimer, the term of this patent is extended or adjusted under 35 U.S.C. 154(b) by 0 days.

(21) Appl. No.: 09/950,648

(22) Filed: Sep. 13, 2001

(65) Prior Publication Data

US 2002/0031431 A1 Mar. 14, 2002

(30) Foreign Application Priority Data

Sep. 13, 2000 (JP) ..... 2000-278396

(51) Int. Cl.[7] ..... F04F 5/44
(52) U.S. Cl. ..... 417/198; 417/196; 417/182
(58) Field of Search ..... 417/198, 182, 417/192, 196

(56) References Cited

U.S. PATENT DOCUMENTS 899,458 A * 9/1908 Murdock ..... 417/198
1,662,101 A * 3/1928 Bossi ..... 417/198
2,571,871 A * 10/1951 Hayes ..... 417/198
4,834,132 A * 5/1989 Sasaki et al. ..... 417/192
5,087,175 A * 2/1992 Raizman et al. ..... 417/196
6,312,230 B1 * 11/2001 Popov ..... 417/196

FOREIGN PATENT DOCUMENTS

| | | | |
|---|---|---|---|
| GB | 2 180 595 | 4/1987 | |
| GB | 2 222 437 | 3/1990 | |
| GB | 2 238 968 | 6/1991 | |
| GB | 2 340 184 | 2/2000 | ..... 417/182 |
| JP | 2598091 | 1/1997 | ..... 417/198 |

* cited by examiner

*Primary Examiner*—Cheryl J. Tyler
(74) *Attorney, Agent, or Firm*—Oblon, Spivak, McClelland, Maier & Neustadt, P.C.

(57) ABSTRACT

A jet pump has a jet nozzle that discharges an operating fluid, a chamber into which a transfer fluid flows and which encloses the end of the jet nozzle, a throat pipe having a constriction portion and a jet nozzle through which the transfer fluid that flows into the chamber is discharged. The discharge end of the throat pipe has a smaller diameter than the base end, and is bent at an angle of approximately 90 degrees from the base end.

20 Claims, 7 Drawing Sheets

JET PUMP THROAT PIPE HAVING A BENT DISCHARGE END

BACKGROUND OF THE INVENTION

1. Field of the Invention

This invention relates to a jet pump that can be installed in an automobile fuel tank where it utilizes the flow of return fuel from the engine as operating fluid for moving fuel from a sub fuel tank to the main fuel tank.

2. Description of the Prior Art

Automobile fuel tanks are usually located in the rear part of the car. Because of the existence of the drive shaft, differential gear and so forth, as shown in FIG. 7, in some cases the center part of the fuel tank t has to be curved inward, giving the fuel tank t a saddle shape. In this case, the tank t is divided into a main tank m in which the fuel pump p is located, and a sub-tank s, so that when there is not much fuel left, fuel in the sub-tank s cannot be fed to the engine.

One arrangement to remedy this comprises installing a jet pump j in the tank t that uses return fuel from the engine as its operating fluid, with the jet pump j being used to move fuel from the sub-tank s to the main tank m. FIG. 6 shows an arrangement of a prior art jet pump j, as disclosed by Japanese Patent No. 2598091. With reference to FIG. 6, the jet pump includes a jet nozzle a that is used to jet return fuel from the engine, a chamber b that encloses the jet nozzle a, an intake pipe e for drawing fuel from the sub-tank s into the chamber b, and a throat pipe d through which, via a constriction portion c at the tip of the jet nozzle a, the return fuel and the transfer fuel is fed to the main tank m.

Return fuel is the excess fuel that has been delivered to the engine by the fuel pump p(see FIG. 7) and is returned to the fuel tank t. In the jet pump j, this return fuel is jetted from the jet nozzle a toward the throat pipe d in the chamber b. The negative pressure, or entrainment pressure, thus generated causes fuel in the sub-tank s to be sucked into the chamber b via the intake pipe e. The transfer fuel from the sub-tank s, together with the return fuel, is discharged into the main tank m from the throat pipe d, thereby transferring fuel from the sub-tank s to the main tank m.

In this case, in order to develop a sufficient negative pressure in the chamber b, it is necessary to effect a liquid seal of the liquid current (fuel flow) in the constriction c, particularly during starting for developing a negative pressure. In the prior art jet pump j, as shown in FIG. 6, this is handled by providing a swing plate f in the jet nozzle a. The swing plate f forms the liquid seal by spreading out the flow of return fuel streaming from the jet nozzle a (as indicated in FIG. 6 by the dot-dash line g).

However, in this prior art jet pump j, the swing plate f used for spreading the jetted stream g of return fuel causes a pressure loss. Because the angle of divergence of the jetted stream g cannot be increased by increasing the angle of the swing plate f, there is a limit to how much the jetted stream g can diverge, so the constriction c and throat pipe d have to have relatively small inside diameters. Thus, the flow of transfer fuel obtained with the jet pump j is not necessarily enough, so there has been a need to improve the transfer flow.

Moreover, factors such as temperature elevation within the chamber b causes cavitation, the forming of bubbles that impede the fuel flow in the vicinity of the inside wall of the throat pipe d. During cavitation, the actual flow path is confined to the center of the throat pipe d, and this, added to the fact that the throat pipe d has to be given a small inside diameter, makes it difficult to secure an adequate flow path during cavitation.

In view of the above drawbacks of the prior art, an object of the present invention is to provide a jet pump that can provide a good liquid seal during starting to thereby generate a sufficient negative pressure, in which the chamber constriction portion and throat pipe do not have to be given particularly small diameters but can be given optimum diameters, making it possible to ensure a sufficient transfer flow, and which enables reduction of the transfer flow during cavitation to be minimized.

SUMMARY OF THE INVENTION

To attain the above object, the present invention provides a jet pump, comprising a jet nozzle that discharges an operating fluid, a chamber that encloses a tip of the jet nozzle and has an internal space into which a transfer fluid flows, a throat pipe having a constriction portion via which the chamber is narrowed from a vicinity of the jet nozzle tip that discharges the transfer fluid that flows into the chamber, the throat pipe formed to have a discharge end with a smaller diameter than that of a base end, with a ratio between base-end inside diameter $D_1$ and discharge-end inside diameter $D_2$ of the throat pipe being set at $D_1/D_2$=1.01–2 and the smaller-diameter portion being bent at an angle of approximately 90 degrees from the base end.

Thus, in the jet pump of this invention, by forming the throat pipe so that the tip has a smaller diameter than the base end and with the smaller-diameter portion having a bend of around 90 degrees from the base end. This ensures that a liquid seal is secured, particularly during starting, generating sufficient negative pressure to ensure a good flow rate of the transfer fluid, and does not involve restrictions such as having to decrease the inside diameter of the chamber throat constriction portion and throat pipe.

Because in the jet pump of this invention the tip of the throat pipe has a smaller diameter than the base end and the smaller-diameter portion is bent at 90 degrees to the base end, when an operating fluid such as return fuel is jetted at the throat pipe from the jet nozzle during starting, the operating fluid dwells momentarily inside the throat pipe, submerging the tip of the jet nozzle to thereby form a liquid seal between the jet nozzle and the chamber constriction and throat pipe base-end portion. The good negative pressure generated by means of this liquid seal enables a good flow of transfer fuel or the like to be achieved. The ratio between the base-end inside diameter $D_1$ and discharge-end inside diameter $D_2$ of the throat pipe is set at $D_1/D_2$=1.01–2, and more preferably is set at $D_1/D_2$=1.05–1.2. By effecting dwelling of the operating fluid during starting, this ensures a good liquid seal and, during the transfer phase following the generation of the negative pressure, enables a good fluid flow rate to be achieved without any deterioration of fluid flow properties in the throat pipe.

The inside diameters of the constriction portion and throat pipe can be optimized for the diameter of the jet nozzle used, to minimize pressure loss over the range in which a good liquid seal can be achieved, maximizing the transfer flow rate that can be achieved under the conditions prescribed. Also, since the constriction and throat pipe can be given sufficiently large diameters to ensure an adequate flow path even during cavitation, it is possible to maintain a good transfer flow rate.

While not limitative, it is desirable for the jet nozzle to be a straight nozzle of a prescribed length and hole diameter that will enable the fluid to be discharged in a straight jet without divergence, since during cavitation this will enable the fluid to flow along the center of the throat pipe without being affected by the cavitation, thereby making it possible to maintain a sufficient transfer fluid flow even when there is cavitation.

Further features of the invention, its nature and various advantages will be more apparent from the accompanying drawings and following detailed description of the invention.

DESCRIPTION OF THE PREFERRED EMBODIMENTS

Figure 1:
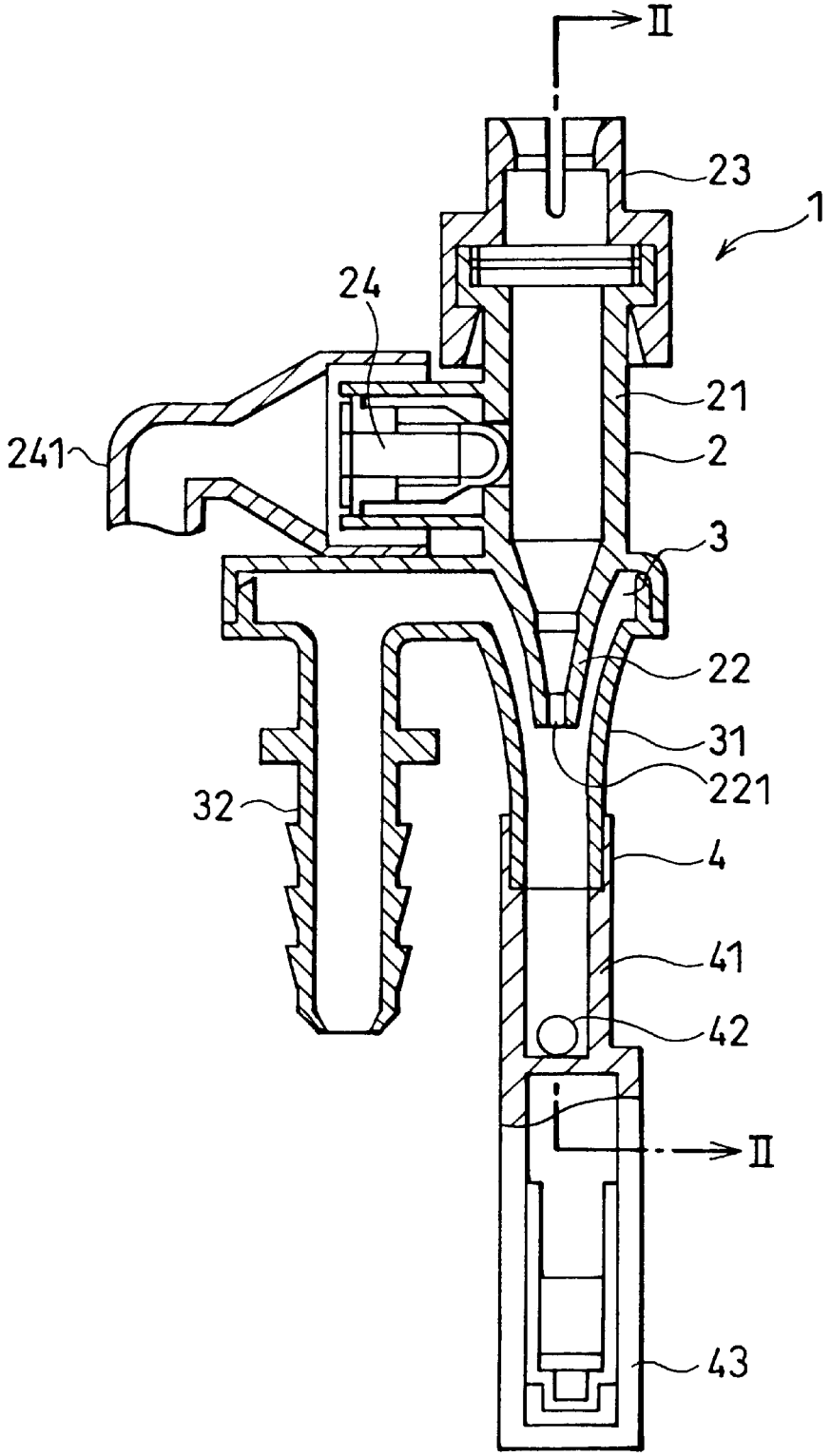
FIG. 1 is a cross-sectional drawing of an embodiment of the jet pump of the invention.
Figure 5:
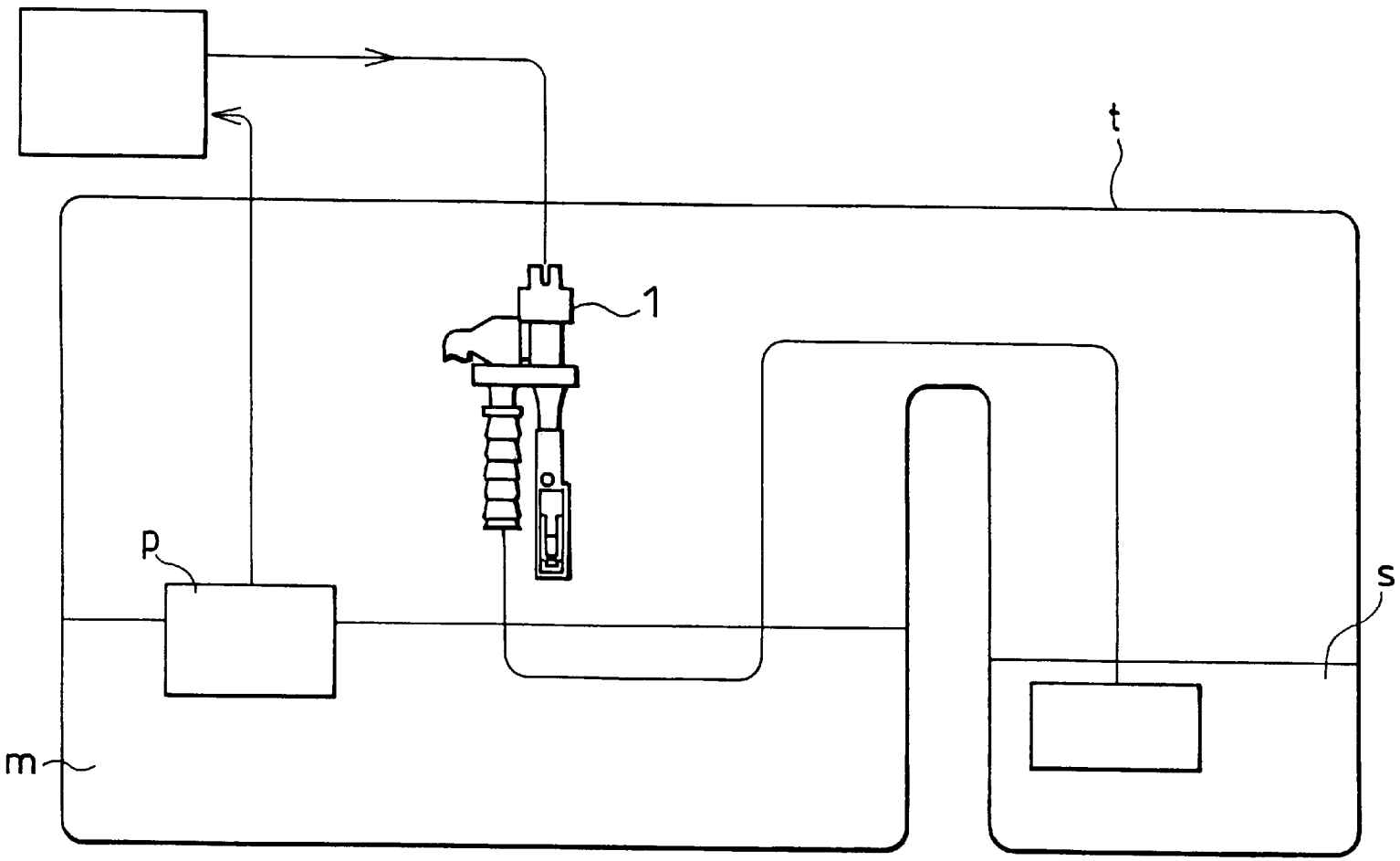
FIG. 5(*a*) shows an example of a flow path configuration in the case of the jet pump of the invention installed in the fuel tank of an automobile, and FIG. 5(*b*) is a perspective view showing the jet pump of the invention installed in a fuel pump module.
Figure 5:
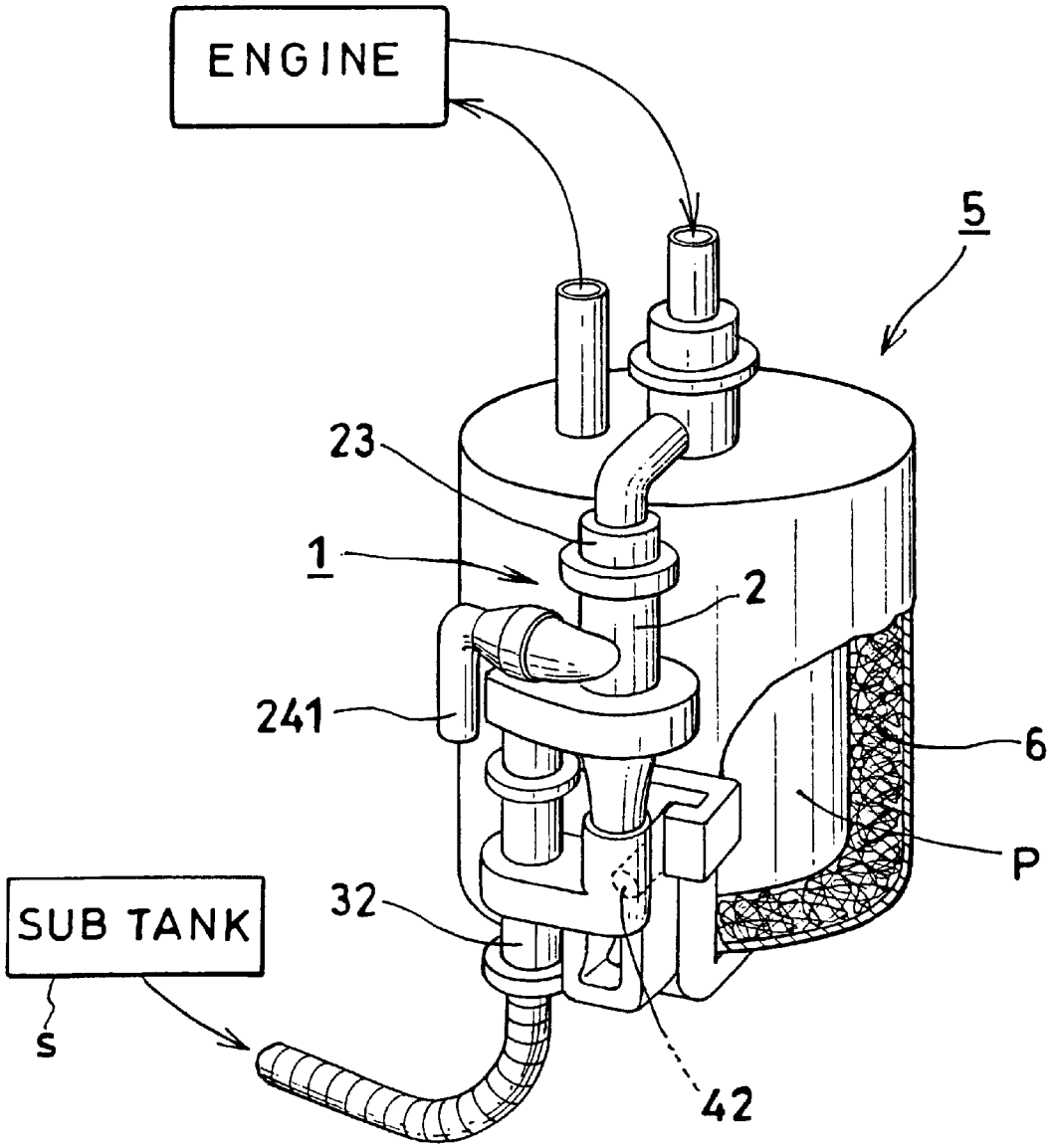
Figure 6:
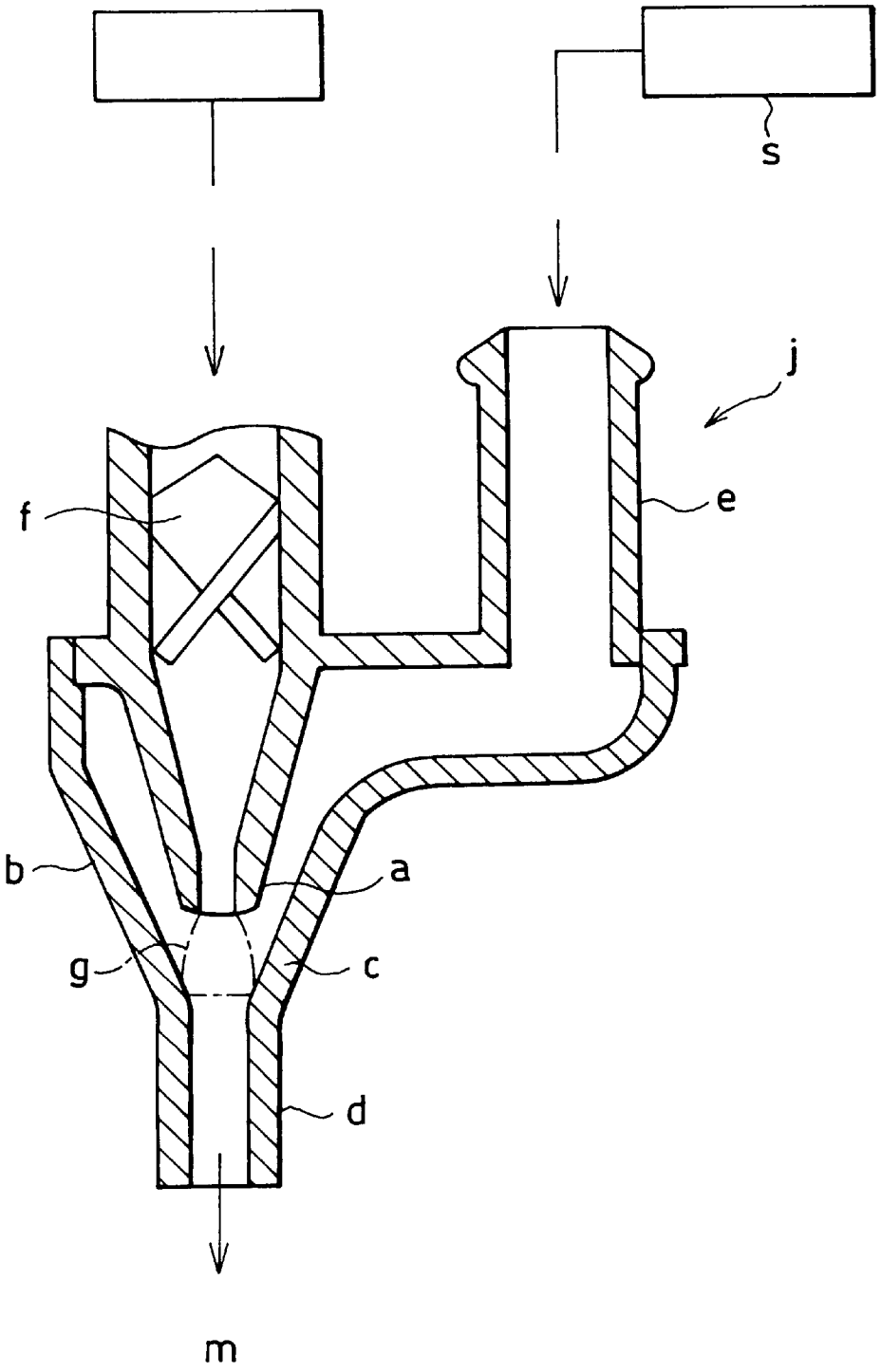
FIG.6 PRIOR ART
FIG. 6 is a cross-sectional view of a prior art jet pump.
Figure 7:
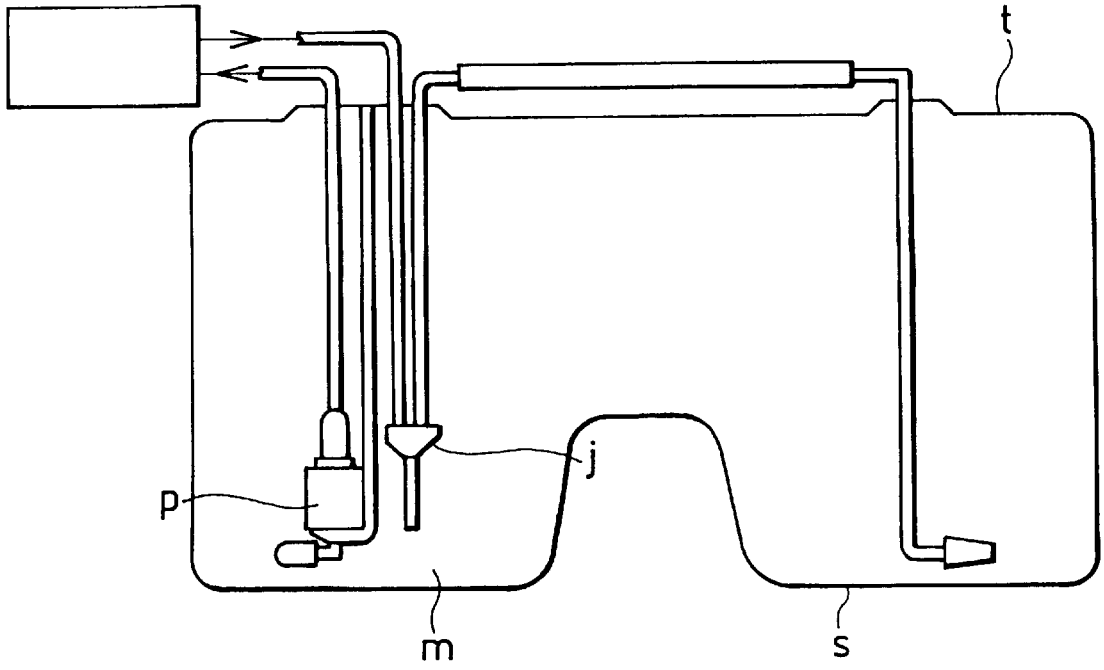
FIG.7 PRIOR ART
FIG. 7 shows an example of a flow path configuration in the case of a prior art jet pump installed in the fuel tank of an automobile.

FIGS. 1 to 4 show a jet pump 1 that is an embodiment of the present invention. As shown in FIG. 5(*a*), the jet pump 1 is provided in an automobile fuel tank t that is divided into a main tank m and a sub-tank s. The jet pump 1 uses return fuel from the sub-tank s to the main tank m in which a fuel or feed pump p is located. As shown in FIG. 1, the jet pump 1 includes a jet nozzle 2 that discharges the return fuel, a chamber 3 in which the tip of the jet nozzle 2 is enclosed, and a throat pipe 4 at the lower part of the chamber 3.

Figure 2:
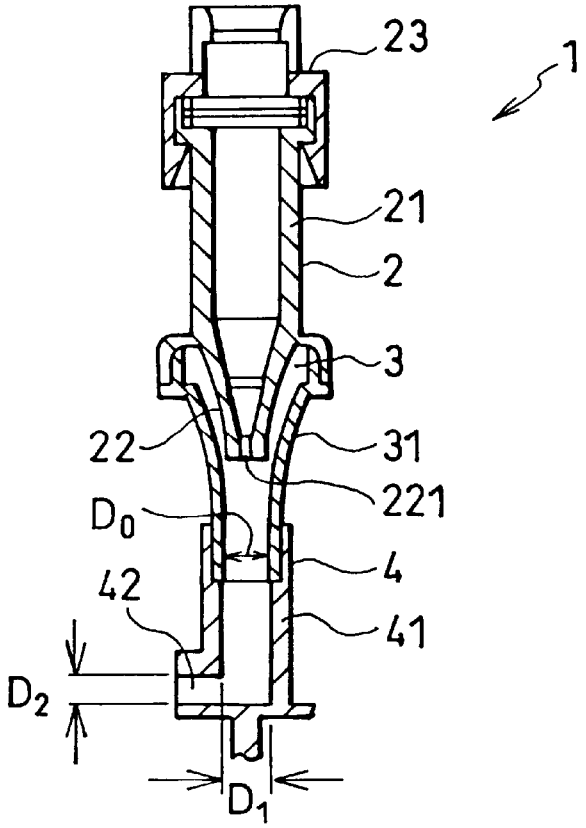
FIG. 2 is a cross-sectional view along line II—II of FIG. 1.

As shown in FIGS. 1 and 2, the jet nozzle 2 comprises a pipe-shaped base portion 21 of a prescribed diameter, and a tapered nozzle portion 22. A cap member 23 is attached to the base end. The cap member 23 is connected to a return pipe via which return fuel is transferred from the engine. The mid-portion of the base portion 21 is provided with an overflow valve 24. When excess return fuel flows into the jet nozzle 2 and the pressure in the jet nozzle 2 exceeds a prescribed level, the excess return fuel flows via the overflow valve 24 and overflow pipe 241 and is discharged to the outside.

Figure 3:
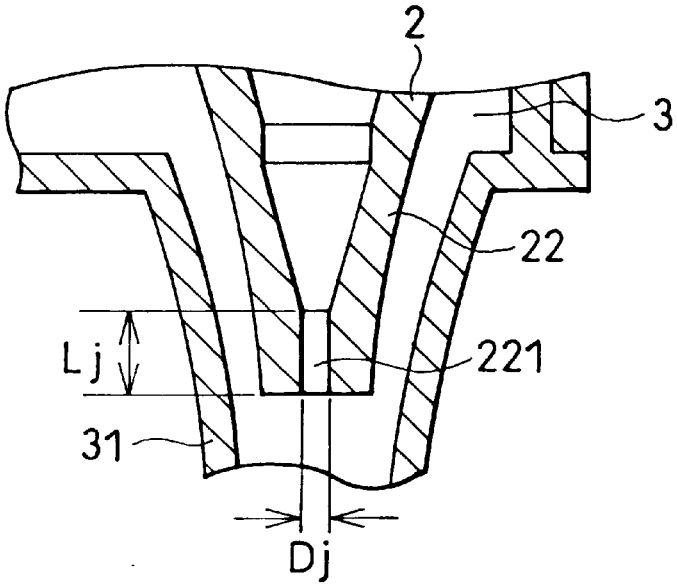
FIG. 3 is an enlarged cross-sectional view showing the tip portion of the jet nozzle of the jet pump of FIG. 1.
Figure 4:
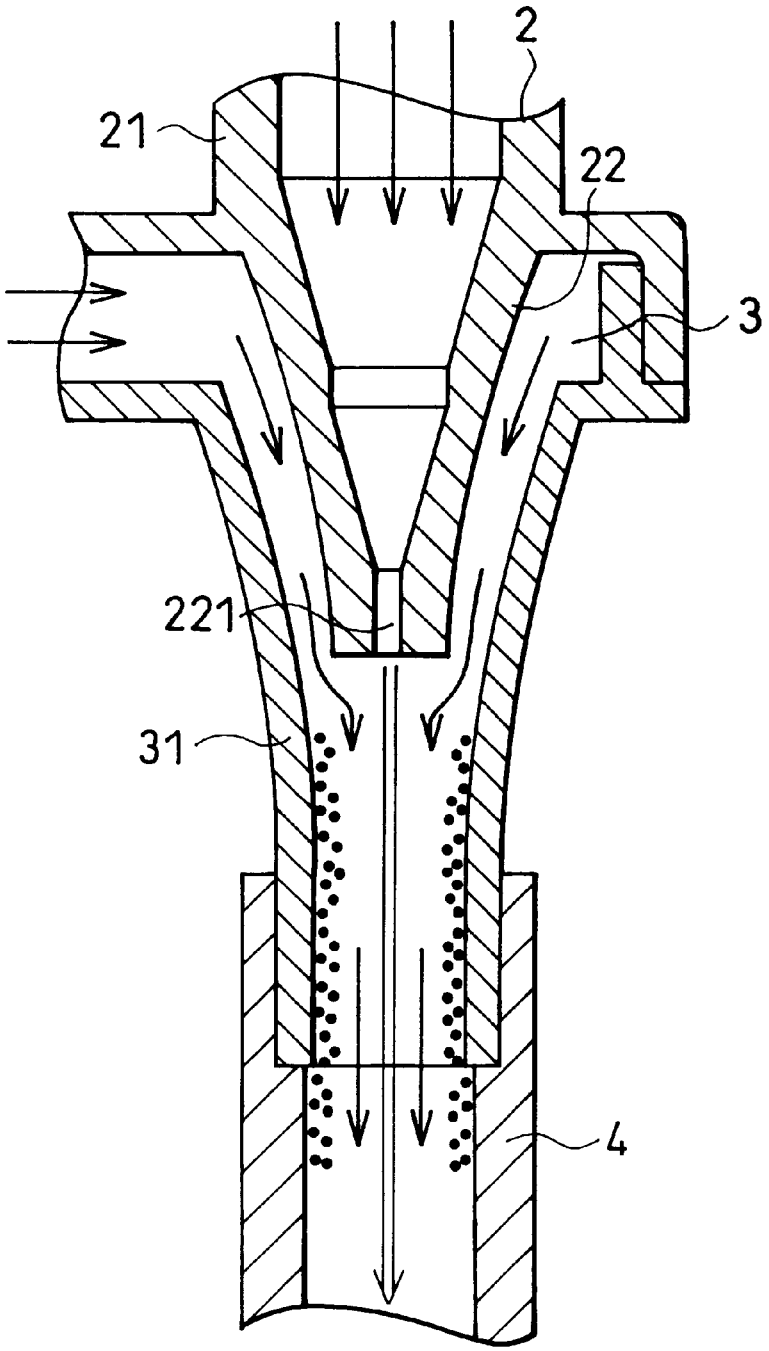
FIG. 4 illustrates the fluid flow in the jet pump of FIG. 1.

As shown in FIG. 3, the tip of the nozzle portion 22 has a straight hole 221 of a prescribed length. The length $L_j$ and diameter $D_j$ of the hole 221 are appropriately set according to the size of the base portion 21 of the jet nozzle 2, the rate at which return fuel flows into the jet nozzle 2, the diameters $D_1$ and $D_2$ of the throat portion, and so forth. While there are no particular limitations on the dimensions, length $L_j$ is set at 1 to 8 mm, and more preferably at 2 to 4 mm, and diameter $D_j$ is set at 0.5 to 3.5 mm, and more preferably to 0.8 and 1.8 mm.

The chamber 3 has an interior space shaped like an elongated oval, one end of which encases the nozzle portion 22 formed at the tip of the jet nozzle 2. The wall of the chamber that extends to form the throat pipe 4 via a constriction portion 31, the narrowing of which corresponds to the nozzle portion 22, so that the tip of the nozzle portion 22 is within the constriction portion 31. Another lower end portion of the chamber 3 is provided with a pipe connector 32 for connecting a transfer pipe via which fuel is transferred from the sub-tank s.

As shown in FIG. 2, the throat pipe 4, which is a separate part from the chamber 3, is formed with the end 42 of the interior passage at 90 degrees to the constriction portion 31 and base-end 41, and with the end 42 having a smaller inside diameter $D_2$ than the inside diameter $D_1$ of the base-end 41. Here too, $D_1$ and $D_2$ are set according to the diameter of the jet nozzle 2, the flow rate from the jet nozzle 2, and so forth. However, the inside diameters $D_1$ and $D_2$ have to be set so that the ratio between them satisfies $D_1/D_2$=1.01 to 2, in order to ensure that during starting, a liquid seal is effected quickly and securely. If $D_1/D_2$ is less than 1.01, during starting it may not be possible to effect good, quick dwelling of the operating fluid, possibly preventing the attainment of the object of the invention. On the other hand, a $D_1/D_2$ that exceeds 2 can result in a marked degradation of flowability in the throat pipe 4, reducing the flow rate of the transfer fluid. More preferably, $D_1/D_2$ should be within the range 1.05 to 1.2. While there is no particular limitation, the diameter $D_1$ of the base-end 41 of the throat pipe 4 should be slightly larger than the diameter $D_0$ of the end of the chamber constriction portion 31 connecting with the base-end 41, to further ensure that the flow rate can be maintained during cavitation. Again, while there is no particular limitation on this, $D_1$ can be made about 0.3 to 2 mm larger than $D_0$, and more preferably about 0.5 to 1.5 mm larger.

In FIG. 1, reference numeral 43 denotes an auxiliary member that is inserted in to a fuel pump (a supply pump) BRKT for preventing loss of the sealed state of the inserted portion of the return pipe when the transfer pipe is subjected to the effect of the fuel sloshing in the tank. The auxiliary member 43 is attached with clips and can be removed during maintenance.

The operation of the jet pump 1 will now be explained. As shown in FIG. 5(*a*), the jet pump 1 is installed in an automobile fuel tank t to transfer fuel from sub-tank s to main tank m. When the engine is started, fuel or feed pump p, located in the main tank m, starts pumping fuel from the main tank m to the engine. Excess fuel is returned to the fuel tank t, where it is run into the jet nozzle 2 of the jet pump 1.

The operation of the jet pump 1 will now be explained. As shown in FIG. 5, the jet pump 1 is installed in an automobile fuel tank t to transfer fuel from sub-tank s to main tank m. When the engine is started, fuel pump p located in the main tank m starts pumping fuel from the main tank m to the engine. Excess fuel is returned to the fuel tank t, where it is run into the jet nozzle 2 of the jet pump 1.

This return fuel flows in a jet from the tip of the nozzle portion 22 and is discharged into the main tank m via the throat pipe 4. As described above, the end of the throat pipe 4 has a 90-degree bend and has a smaller diameter $D_2$ than the base-end 41 diameter $D_1$, in accordance with the ratio prescribed for $D_1/D_2$. As a result, the return fuel dwells momentarily within the throat pipe 4, so the tip of nozzle portion 22 becomes submerged in the dwelling return fuel, forming a liquid seal between the tip of the nozzle portion 22 and the constriction portion 31 and base-end 41 portion.

The negative pressure (entrainment pressure) thus generated causes fuel in the sub-tank s to be sucked into the chamber 3 via the transfer pipe and connector 32. Via throat pipe 4, this fuel, along with the return fuel, is discharged from the jet pump 1 into the main tank m. Thus, in the jet pump 1 of this invention, by forming the throat pipe 4 so that the diameter at the discharge end 42 is smaller than the diameter of the base-end 41 and the end 42 is at 90 degrees to the base-end 41, when the fuel is jetted from the jet nozzle 2 into the throat pipe 4 during starting, the momentary dwelling of the fuel in the throat pipe 4 submerges the tip of the nozzle portion 22 of the jet nozzle 2, forming a liquid seal between the nozzle portion 22 and the chamber constriction portion 31 of the chamber 3 and throat pipe base-end 41 portion that enables sufficient negative pressure to be generated to effect the requisite transfer of fuel.

The inside diameters of the constriction portion 31 and throat pipe 4 can be optimized for the diameter of the nozzle portion 22 used, to minimize pressure loss over the range in which a good liquid seal can be achieved, maximizing the transfer flow rate that can be achieved. Also, since the constriction portion 31 and throat pipe 4 can be given sufficiently large diameters to ensure an adequate flow path even during cavitation, a good transfer flow rate can be maintained.

As described in the above, the tip of the nozzle portion 22 has a straight hole 221 of a prescribed length and diameter that enable an excellent jet flow to be maintained even during cavitation, generating a good enough negative pressure to ensure a sufficient transfer flow rate. Specifically, the return fuel flows from the hole 221 of the prescribed length and diameter in a straight jet with hardly any spread, flowing along the center of the constriction portion 31 and throat pipe 4. Therefore, even when cavitation arises, preventing the fuel from flowing through the constriction portion 31 and throat pipe 4 in proximity to the walls thereof, it is still possible to obtain a good jet flow, and therefore good negative pressure, to maintain the desired transfer flow rate.

In FIG. 5(*a*), the jet pump 1 and the fuel or feed pump p are shown as being completely separated. However, as shown in FIG. 5(*b*), a fuel pump module 5, having a fuel filter 6 and a feed or fuel pump p, can be used that is attached to the jet pump 1 in the fuel tank t. In this case, return and transfer fuel discharged from the horizontally oriented end 42 of the throat pipe can be arranged so that it is sprayed onto the fuel filter 6 of the fuel pump module 5, preventing the pump becoming electrostatically charged. Integration of the jet pump 1 and the fuel pump module 5 can also be done to save space.

The jet pump of the present invention is not limited to the jet pump 1 of the foregoing embodiments. Instead, the configuration of the parts and the way the parts are combined can be varied and modified to the extent that such variations and modifications do not depart from the defined scope of the invention. Similarly, while in the foregoing examples the jet pump of the invention has been described with reference to using it in a fuel tank of an automobile or the like where it utilizes return fuel to transfer fuel from a sub-tank to a main tank, the invention is not limited to such an application, and may instead be used for any purpose to which a jet pump can be applied.

As described in the foregoing, in accordance with the jet pump of this invention, during starting a negative pressure is generated that enables a good liquid seal to be formed. Moreover, the chamber constriction portion and throat pipe do not have to be given particularly small diameters but can be given optimum diameters, making it possible to ensure a sufficient transfer flow and to minimize degradation of transfer flow rate during cavitation.

What is claimed is:

1. A jet pump, comprising:

a jet nozzle that discharges an operating fluid;

a chamber that encloses a tip of the jet nozzle and has a constriction portion and an internal space into which a transfer fluid flows;

a throat pipe connected to the chamber via the constriction portion of the chamber in a vicinity of the jet nozzle tip, the throat pipe discharging the transfer fluid that flows into the chamber, the throat pipe being formed to have a discharge-end with a smaller diameter than a diameter of a base-end thereof, with a ratio between a base-end inside diameter $D_1$ and a discharge-end inside diameter $D_2$ of the throat pipe being set at $D_1/D_2$=1.01 to 2 and the discharge-end of the throat pipe forming a smaller-diameter portion being bent at an angle of approximately 90 degrees from the base end, wherein the operating fluid, discharged from the jet nozzle, dwells in the throat pipe to submerge the tip of the jet nozzle so that a liquid seal is formed between the tip of the jet nozzle and any one of the constriction portion of the chamber and the base-end of the throat pipe.

2. A jet pump according to claim 1, wherein the base end of the throat pipe has an inside diameter that is larger than an inside diameter of the constriction portion of the chamber.

3. A jet pump according to claim 2, wherein the jet nozzle is a straight nozzle having a prescribed length and hole diameter.

4. A jet pump according to claim 3, wherein the jet pump is a fuel transfer jet pump that is located in a fuel tank and utilizes a flow of return fuel from the engine as operating fluid for transferring fuel to a prescribed location in the fuel tank.

5. A jet pump according to claim 4, wherein the fuel tank in which the jet pump is located is divided into a main tank in which there is a fuel pump and a sub-tank, and is used for transferring fuel from the sub-tank to the main tank.

6. A jet pump according to claim 5, wherein the jet pump is affixed to a fuel pump module having a fuel filter and feed pump and is configured so that return fuel and transfer fuel discharged from the end of the throat pipe sprays onto the fuel filter of the fuel pump module.

7. A jet pump according to claim 4, wherein the jet pump is affixed to a fuel pump module having a fuel filter and feed pump and is configured so that return fuel and transfer fuel discharged from the end of the throat pipe sprays onto the fuel filter of the fuel pump module.

8. A jet pump according to claim 2, wherein the jet pump is a fuel transfer jet pump that is located in a fuel tank and utilizes a flow of return fuel from the engine as operating fluid for transferring fuel to a prescribed location in the fuel tank.

9. A jet pump according to claim 8, wherein the fuel tank in which the jet pump is located is divided into a main tank in which there is a fuel pump and a sub-tank, and is used for transferring fuel from the sub-tank to the main tank.

10. A jet pump according to claim 9, wherein the jet pump is affixed to a fuel pump module having a fuel filter and feed pump and is configured so that return fuel and transfer fuel discharged from the end of the throat pipe sprays onto the fuel filter of the fuel pump module.

11. A jet pump according to claim 8, wherein the jet pump is affixed to a fuel pump module having a fuel filter and feed pump and is configured so that return fuel and transfer fuel discharged from the end of the throat pipe sprays onto the fuel filter of the fuel pump module.

12. A jet pump according to claim 1, wherein the jet nozzle is a straight nozzle having a prescribed length and hole diameter.

13. A jet pump according to claim 12, wherein the jet pump is a fuel transfer jet pump that is located in a fuel tank and utilizes a flow of return fuel from the engine as operating fluid for transferring fuel to a prescribed location in the fuel tank.

14. A jet pump according to claim 13, wherein the fuel tank in which the jet pump is located is divided into a main tank in which there is a fuel pump and a sub-tank, and is used for transferring fuel from the sub-tank to the main tank.

15. A jet pump according to claim 14, wherein the jet pump is affixed to a fuel pump module having a fuel filter and feed pump and is configured so that return fuel and transfer fuel discharged from the end of the throat pipe sprays onto the fuel filter of the fuel pump module.

16. A jet pump according to claim 13, wherein the jet pump is affixed to a fuel pump module having a fuel filter and feed pump and is configured so that return fuel and transfer fuel discharged from the end of the throat pipe sprays onto the fuel filter of the fuel pump module.

17. A jet pump according to claim 1, wherein the jet pump is a fuel transfer jet pump that is located in a fuel tank and utilizes a flow of return fuel from the engine as operating fluid for transferring fuel to a prescribed location in the fuel tank.

18. A jet pump according to claim 17, wherein the fuel tank in which the jet pump is located is divided into a main tank in which there is a fuel pump and a sub-tank, and is used for transferring fuel from the sub-tank to the main tank.

19. A jet pump according to claim 18, wherein the jet pump is affixed to a fuel pump module having a fuel filter and feed pump and is configured so that return fuel and transfer fuel discharged from the end of the throat pipe sprays onto the fuel filter of the fuel pump module.

20. A jet pump according to claim 17, wherein the jet pump is affixed to a fuel pump module having a fuel filter and feed pump and is configured so that return fuel and transfer fuel discharged from the end of the throat pipe sprays onto the fuel filter of the fuel pump module.

* * * * *

UNITED STATES PATENT AND TRADEMARK OFFICE

CERTIFICATE OF CORRECTION

PATENT NO. : 6,575,705 B2
DATED : June 10, 2003
INVENTOR(S) : Akiyama et al.

It is certified that error appears in the above-identified patent and that said Letters Patent is hereby corrected as shown below:

Title page,
Item [73], Assignee, should read:
-- [73] Assignees: Nissan Motor Co., Ltd ., Yokohama (JP); NIFCO INC., Yokohama (JP) --

Signed and Sealed this

Twenty-third Day of September, 2003

JAMES E. ROGAN
*Director of the United States Patent and Trademark Office*